US010847021B1

(12) United States Patent
Scalise et al.

(10) Patent No.: US 10,847,021 B1
(45) Date of Patent: Nov. 24, 2020

(54) DETERMINING COMMANDS ON A MEDIA DEVICE INTERFACE

(71) Applicant: Amazon Technologies, Inc., Seattle, WA (US)

(72) Inventors: Albert M. Scalise, San Jose, CA (US); Jano D. Banks, Cupertino, CA (US); Andrew S. Brenner, Sunnyvale, CA (US); Christopher D. Painter, Fremont, CA (US)

(73) Assignee: Amazon Technologies, Inc., Seattle, WA (US)

( * ) Notice: Subject to any disclaimer, the term of this patent is extended or adjusted under 35 U.S.C. 154(b) by 541 days.

(21) Appl. No.: 15/478,152

(22) Filed: Apr. 3, 2017

Related U.S. Application Data

(62) Division of application No. 13/602,794, filed on Sep. 4, 2012, now Pat. No. 9,640,067.

(51) Int. Cl.
*G08C 17/02* (2006.01)

(52) U.S. Cl.
CPC ..... *G08C 17/02* (2013.01); *G08C 2201/20* (2013.01)

(58) Field of Classification Search
CPC ... H04N 2005/4435; H04N 2005/4437; H04N 21/42226; G08C 19/28; G08C 2201/20; G08C 2201/92; G08C 17/02; H05B 37/0272; G07C 9/00182
See application file for complete search history.

(56) References Cited

U.S. PATENT DOCUMENTS

| | | | | |
|---|---|---|---|---|
| 2004/0266419 | A1* | 12/2004 | Arling ..... | G08C 17/00 455/420 |
| 2009/0254500 | A1 | 10/2009 | Stecyk | |
| 2009/0322583 | A1 | 12/2009 | Reams et al. | |
| 2010/0053468 | A1 | 3/2010 | Harvill | |
| 2012/0079533 | A1 | 3/2012 | Wong et al. | |
| 2014/0028539 | A1 | 1/2014 | Newham et al. | |

* cited by examiner

*Primary Examiner* — Omer S Khan
(74) *Attorney, Agent, or Firm* — Eversheds Sutherland (US) LLP

(57) ABSTRACT

Described herein are systems and methods for a media controller configured to associate data from a media device received using a media device interface with actions on the media devices. The associated data and actions may be used to build a media device interface command map. The media device interface command map may be used by the media controller to control the media device. A user interface provided by the media controller may thus be used to control disparate devices, allowing for a coordinated and consistent user experience across multiple media devices, even when they are from different manufacturers.

19 Claims, 9 Drawing Sheets

| Media Device ID 404 | Command 406 | Assigned Action 408 |
|---|---|---|
| GR93 | 7570206368616e6e656c | Channel up on cable box |
| GR93 | 706f776572206f6e | Power on cable box |
| TV12 | 6368207570 | Channel up on TV |
| TV12 | 706f776572206f6666 | Power off TV |
| TV12 | 766f6c20646f776e | Volume down on TV |
| Diskplayer 2 | 7475726e206f6e | Power on DVD player |
| Diskplayer 2 | 6d61696e206d656e75 | Main menu on DVD player |
| Diskplayer 2 | 73686970206368 | Skip chapter on DVD Player |

...

⋮

DETERMINING COMMANDS ON A MEDIA DEVICE INTERFACE

CROSS-REFERENCE TO RELATED APPLICATION(S)

This application is a division of U.S. application Ser. No. 13/602,794, filed Sep. 4, 2012, and titled "Determining Commands on a Media Device Interface," the content of which is hereby incorporated by reference in its entirety.

BACKGROUND

A wide variety of content is available to users for access electronically. This content may include television programming, eBooks, music, movies, games, and so forth. The content may be delivered using broadcast, cable, satellite, Internet, playback from a local media device such as a digital versatile disk ("DVD"), compact disc ("CD"), flash memory, hard disk drive, and so forth.

Traditionally, each of these different pieces of content has involved a different media device to access or consume. As a result, in locations where content is consumed, such as a user's living room, home theater, conference room, and so forth, a bewildering assortment of media devices used to access this content may be found. For example, these different media devices may include, but are not limited to broadcast satellite receivers, broadcast radio receivers, cable television interface boxes, game consoles, DVD players, CD players, tablet computers, smart phones, and so forth. Each of these different devices may present different user interfaces such as different remote controls and on-screen menus to users. This results in a user experience in which consumption of content is unnecessarily complicated.

Figure 1:
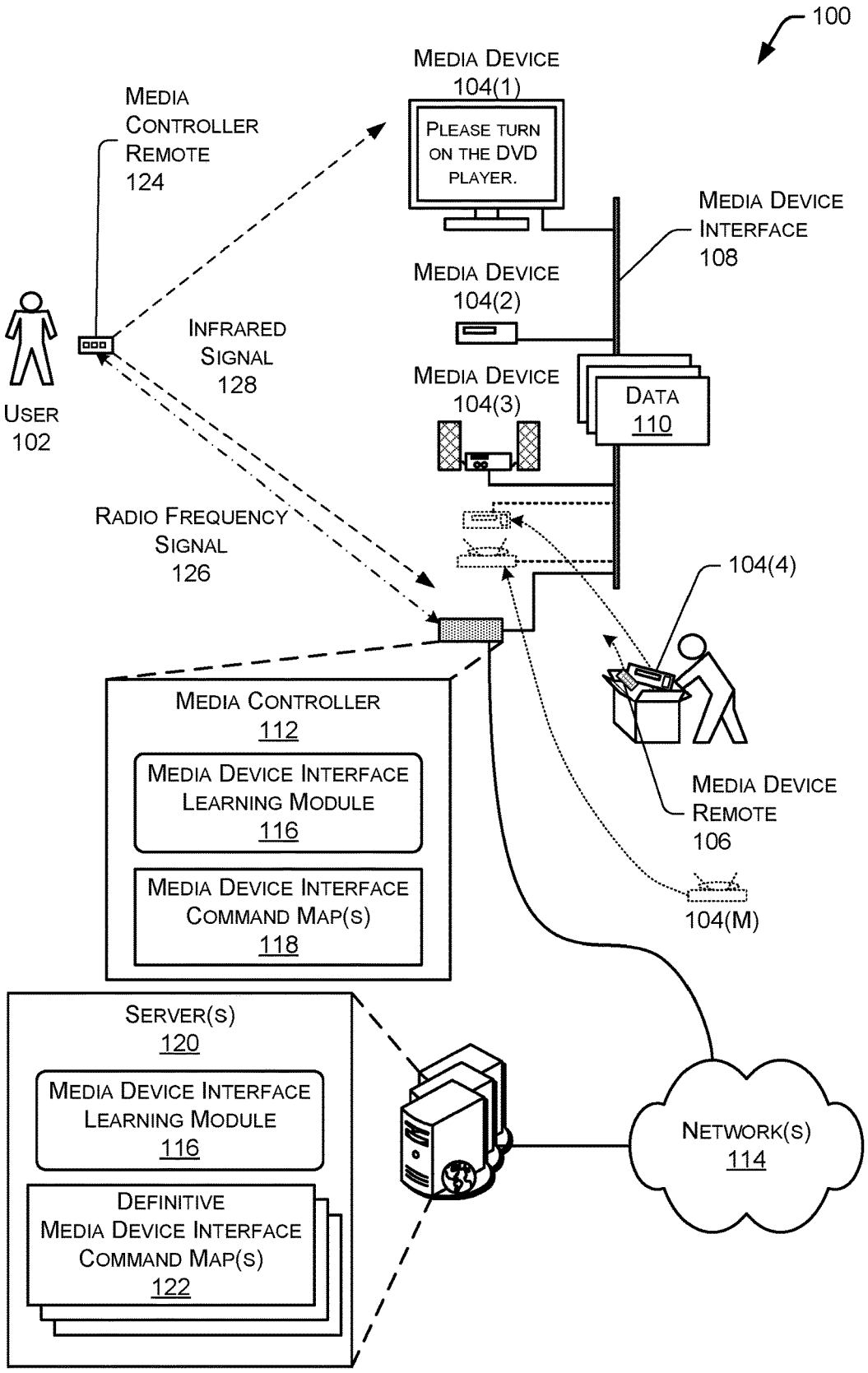
FIG. 1 illustrates a system for presenting content to users which includes a media controller configured to control media devices using a media device interface.

Certain implementations will now be described more fully below with reference to the accompanying drawings, in which various implementations and/or aspects are shown. However, various aspects may be implemented in many different forms and should not be construed as limited to the implementations set forth herein. Like numbers refer to like elements throughout.

DETAILED DESCRIPTION

A vast and ever growing collection of content is available for users to access. This content may include television programming, eBooks, music, movies, games, and so forth. The content may be delivered using broadcast, cable, satellite, Internet, playback from a local media device such as a digital versatile disk ("DVD"), compact disc ("CD"), flash memory, hard disk drive, and so forth.

As the collection of content grows, so the collection of media devices used to access this content grows as well. Traditionally, each piece of content has involved a different media device to access or consume. For example, a user's living room may contain media devices such as a television, a broadcast satellite receiver, a broadcast radio receiver, a sound system, a cable television interface box, a game console, and so forth.

Each of these different devices may present different user interfaces such as different remote controls and on-screen menus to users. Furthermore, as the mix of devices may vary between users, what is familiar to one user may be unfamiliar to another. This results in a user experience in which consumption of content may be complicated. For example, consider the scenario where a user wishes to watch a movie streamed from the Internet. This may involve tedious or complicated setup to allow for remote control of the media devices. Once configured, actual consumption of the content may involve dozens of steps such as turning on the various media devices in a particular order, selecting from several input sources on the television, selecting settings on the sound system, maneuvering through many menus to select a particular movie, and so forth. These steps may require issuing numerous commands to the devices, typically using one or more different media device remote controls. As a result, the overall user experience associated with consuming the content is unnecessarily unpleasant.

Described herein are devices and methods for configuring a media controller to control one or more media devices using a media device interface. The media controller may be configured to provide centralized control and coordination for operation of the one or more media devices. Instead of using various media device remote controls and user interfaces, the user may use the user interface provided by the media controller. For example, rather than the user accessing individual controls on the television, sound system, and a DVD player, the media controller may be configured to send commands to these devices using the media device interface.

The media device interface enables communication between the media controller and the one or more media devices. The media device interface may comprise a high-definition multimedia interface ("HDMr") connection using a feature set such as the Consumer Electronics Control ("CEC"), local area network ("LAN"), wireless local area network ("WLAN"), personal area network ("PAN") such as Bluetooth™, ZigBee and application profiles of ZigBee such as RF4CE, and so forth. However, different manufacturers may implement commands on the media device interface differently and is not necessarily standardized. For example, the command to "power on" a media device from one manufacturer may differ from another.

The media controller contains a learning module configured to capture at least some of the data such as CEC commands, sent along the media device interface, such as HDMI connection. This data may be analyzed and used to determine an appropriate media device command map ("map") for the media device. The media device command map associates particular actions with commands and may then be used by the media controller to generate commands to the particular media device.

In one implementation, the media device command map may be unavailable. For example, the media device may be newly released and map data may not yet be available. The media controller may present a user interface with prompts configured to elicit particular actions which in turn generate particular commands. For example, a prompt may ask the user to turn on and off the particular media device. The learning module of the media controller may capture at least some of the data on the media device interface which occurs contemporaneously with the user's input, and began to associate the commands received with the actions of the media device. Using various machine learning techniques, the learning module may create a media device interface command map for the particular media device. The map associates a particular action with a particular command on the media device interface.

In some implementations where the media device command map is unavailable, the media controller may capture at least some of the data on the media device interface over a period of time. This may be combined with other data such as input from the user made by a media device remote, the media controller remote, and so forth. Over time, even without prompting the user, the learning module builds the association of commands received with the actions of the media device. From these associations, the learning module may create the media device interface command map for the particular device. When the map is built, to user may be prompted to implement the media device interface command map.

Where the media device command map corresponding to the media device is available, the media controller may retrieve this map. Once created or retrieved, the media device interface command map allows the media controller to control and otherwise interact with the media device. By providing this control capability, the media controller may provide a single consistent and coherent user interface to the user, regardless of what media device is coupled to the system. This improves usability and the overall user experience in consuming content.

Illustrative System

FIG. 1 illustrates a system 100 for presenting content to one or more users for consumption. The content may include television programming, movies, eBooks, audiobooks, music, audio, games, and so forth. The content may be delivered using broadcast, cable, satellite, network such as the Internet, playback from a local media device such as a digital versatile disk ("DVD"), compact disc ("CD"), flash memory, hard disk drive, and so forth. A single user 102 is shown, however more than one user 102 may consume content at a given time. For example, several users 102 may watch a movie or play a game together.

One or more media devices 104 are illustrated. These media devices 104(1), 104(2), . . . , 104(M) may include televisions, display devices, broadcast satellite receivers, broadcast radio receivers, cable television interface boxes, game consoles, digital versatile disk ("DVD") players, Blu-Ray™ players, compact disk ("CD") players, and so forth. For example, as shown here the system 100 comprises a television media device 104(1), a DVD player media device 104(2), and a sound system media device 104(3). Over time users may add or remove media devices 104 to the system 100. For example, the user 102 may add a cable television interface box media device 104(4), and other media devices 104(M). One or more of the media devices 104 may be configured to operate in conjunction with a media device remote 106. The media device remote 106 may be configured to accept input from the user 102 such as a key press and generate a command for an associated media device 104 such as an infrared signal. For example, the cable television interface box 104(4) may include a media device remote 106 allowing the user to change channels, view an electronic program guide, and so forth. The media device remote 106 may be configured to communicate with the media device 104. This communication may use an infrared interface. For example, the media device remote 106 may transmit an infrared signal corresponding to a particular command using an infrared light emitting diode (LED) and the associated media device 104 may receive the infrared signal with an infrared photodetector.

The media devices 104 may be coupled to one another with a media device interface 108. The media device interface 108 may comprise a high-definition multimedia interface ("HDMI") connection using a feature set such as the Consumer Electronics Control ("CEC"), local area network ("LAN"), wireless local area network ("WLAN"), personal area network ("PAN") such as Bluetooth™, and so forth. The media device interface 108 may comprise a wired bus or common set of wireless protocols allowing for the media devices 104 on the media device interface 108 to receive communication from other media devices 104. For example, a command interchange between a DVD player and a television may also be received by the other devices on the media device interface 108, such as the cable television interface box media device 104(4).

The media device interface 108 may transfer data 110 in analog, digital, or combined analog and digital data formats. The data may include image data, audio data, control data, and so forth. For example, the television media device 104(1) may receive a video stream using the media device interface 108 from the DVD player 104(2).

Instead of or in addition to content-related information such as audio and video, communication between the media devices 104 may include status information, commands, and so forth. For example, when the cable television interface box 104(4) powers on, it may send a power up status message across an HDMI media device interface 108. In another example, a command may be sent along the media device interface 108 to the television 104(1) to select a particular video input.

As described above, the many media devices 104 available to present content to the user 102 may be complicated to control. A media controller 112 may be connected to the one or more media devices 104, such as using one or more of the media device interfaces 108. The media controller 112 may be configured to provide a user interface to the user 102, receive status information about the one or more media devices 104 using the media device interfaces 108, issue commands to one or more of the media devices 104, present content, and so forth. For example, the media controller 112 may be configured to provide a user interface to the user 102 and generate commands allowing for the operation of the one or more media devices 104.

The media controller 112 and one or more of the media devices 104 may be configured to couple with communication interfaces to one or more networks 114. The network 114 may comprise one or more private networks, public networks such as the Internet, or a combination of both configured to transfer data between two or more devices.

The media controller 112 may include a media device interface learning module 116 ("learning module"). The learning module 116 is configured to generate a media device interface command map 118 ("map") based at least in part on learning input data such as the data 110 received from the media device interface 108, input from infrared receivers, user input from the user 102, and so forth. The learning module 116 may be configured to associate data received on the media device interface 108 with actions or sequences of events on the various media devices 104. The media controller 112 is discussed in more detail below with regard to FIG. 2. The map 118 may be associated with a particular device, vendor, family of devices, and so forth. The learning module 116, map 118, determination, and generation are discussed in more detail below with regard to FIGS. 6-10.

One or more servers 120 or other remote devices are coupled to the network 114. The server 120 may provide various services to the media controller 112, the one or more media devices 104, or combinations thereof. The server 120 may include a media device interface learning module 116 configured to generate media device interface command maps 118.

In one implementation, the server 120 may be configured to receive the media device interface command maps 118 from one or more media controllers 112. The server 120 may also process these maps 118 to determine a definitive media device interface command map 122 ("definitive map"). The definitive map 122 may be considered an authoritative or verified map. For example, the, server 120 may process a plurality of maps 118 received from different media controllers 112 to remove erroneous entries, incorrect mappings, and so forth to create the definitive map 122. Unless explicitly stated otherwise, for ease of discussion, references made herein to the media device interface command maps 118 are also understood to refer to the definitive media device interface command maps 122.

In some implementations the media device interface learning module 116 or a portion thereof may execute on the server 120. For example, the media controller 112 may acquire the learning input data and transfer at least a portion via the network 114 to the server 120 for processing. The learning module 116 executing on the server 120 may be configured to process learning input data collected from a plurality of media controllers 112. In some implementations, this aggregation of data may decrease the time to generate the map 118, increase the accuracy of the map 118, and provide other advantages.

The servers 120 may provide other services including, but not limited to, storage of content, streaming content, indexing of content, control, programming, and so forth. For example, the server 120 may provide a web based interface accessible by the user 102 when at a location other than the media controller 112 to allow for control or configuration of the media controller 112 over the network 114. In another example, the server 120 may provide a video stream to the media controller 112 or the media device 104 for presentation.

A media controller remote 124 may be used in conjunction with the media controller 112. The media controller remote 124 is a portable input/output device. The media controller remote 124 may be provided in a variety of form factors such as a tablet, slate, generally rectangular cuboid configured for single-handed use, wand, and so forth. The media device remote 106 and the media controller remotes 124 are depicted in this disclosure as generally rectangular cuboids for convenience of illustration and not by way of limitation. The form factors, sizes, and so forth may differ between the media controller remote 124 and various media device remotes 106. For example, the media device remote 106 may be a generally rectangular cuboid configured for single-handed use while the media controller remote 124 comprises a tablet shape.

The media controller remote 124 is configured to communicate with the media controller 112. Communication between the media controller remote 124 and the media controller 112 may use a wired or wireless connection. The wired connection may comprise an optical fiber, electronic conductor, or other physical coupling between the media controller remote 124 and the media controller 112. The wireless connection may comprise optical, acoustic, electromagnetic, or other means to transmit information between the media controller remote 124 and the media controller 112. In one implementation the wireless connection comprise radio frequency ("RF") signals 126.

Communication between the media controller remote 124 and the media controller 112 may use a proprietary protocol, standard protocol, or a combination thereof. For example, the media controller remote 124 and the media controller 112 may comprise RF interfaces compliant with the Bluetooth™ standard. Communication between the media controller remote 124 and the media controller 112 may be bidirectional or unidirectional.

The media controller remote 124 may also be configured to communicate with the one or more media devices 104. This communication may be direct from the media controller remote 124 to the media device 104, or may be via the media controller 112. In some implementations, the media controller remote 124 may comprise one or more infrared emitters configured to generate infrared signals 128. The media controller remote 124 is discussed in more detail below with regard to FIG. 3.

An infrared signaling code table or other data structure may be used by the media controller 112 to associate a particular command with a particular infrared signal waveform.

In some implementations, the infrared signals 128 may also be used to communicate with the media controller 112. For example, the infrared signals 128 may be received by the media controller 112 and interpreted to indicate orientation of the media controller remote 124.

Figure 2:
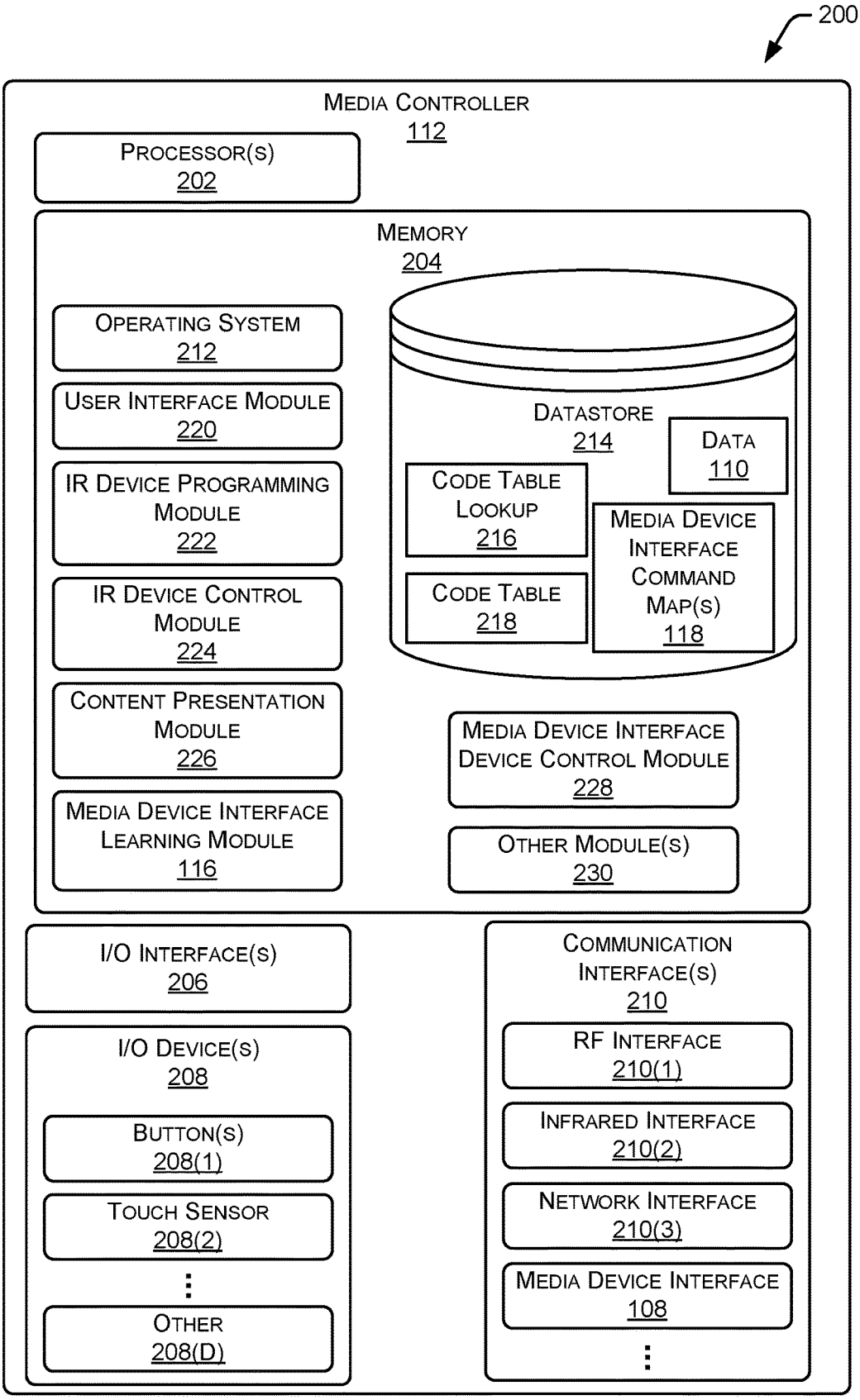
FIG. 2 illustrates a block diagram of the media controller configured with a media device interface learning module configured to build and use the media device interface command map to control the media device.

FIG. 2 illustrates a block diagram 200 of the media controller 112 which may be configured to control one or more media devices 104. The media controller 112 may comprise one or more processors 202, one or more memories 204, one or more input/output ("I/O") interfaces 206, one or more I/O devices 208, and one or more communication interfaces 210.

The processor 202 may comprise one or more cores and is configured to access and execute at least in part instructions stored in the one or more memories 204. The one or more memories 204 comprise one or more computer-readable storage media ("CRSM"). The one or more memories 204 may include, but are not limited to, random access memory ("RAM"), flash RAM, magnetic media, optical media, and so forth. The one or more memories 204 may be volatile in that information is retained while providing power or non-volatile in that information is retained without providing power.

The one or more I/O interfaces 206 allow for coupling I/O devices 208 to the media controller 112. The I/O interfaces 206 may comprise inter-integrated circuit ("I2C"), serial peripheral interface bus ("SPI"), universal serial bus ("USB"), RS-232, RS-432, and so forth. The I/O devices may include buttons 208(1) such as in keypads or keyboards, or touch sensors 208(2). The buttons 208(1) may include mechanical buttons, softkeys, keys with integrated displays, and so forth. The touch sensors 208(2) may comprise interpolating force sensing resistor ("IFSR") arrays, capacitive sensors, optical touch sensors, and so forth.

One or more other I/O devices 208(D) such as speakers, microphones, displays, external memory devices, global positioning system receivers, and so forth may also be coupled to the media controller 11 2112 using the I/O interfaces 206.

The one or more communication interfaces 210 provide for the transfer of data between the media controller 11 2112 and other devices such as the media controller remote 124, the servers 120, and so forth. The communication interfaces 210 may include, but are not limited to, PANs, wired local area networks ("LANs"), wireless local area networks ("WLANs"), wireless wide area networks ("WWANs"), and so forth. As shown here, the communication interfaces 210 may comprise one or more RF interfaces 210(1), one or more infrared interfaces 210(2), one or more network interfaces 210(3), one or more media device interfaces 210(4), one or more other interfaces, or a combination thereof.

The RF interface 210(1) may comprise a radio transmitter, radio receiver, or radio transceiver. The RF interface 210(1) may be compliant with one or more standard protocols, such as the Bluetooth™ PAN. The infrared interface 210(2) may comprise an infrared transmitter, infrared receiver, or an infrared transceiver. In some implementations the infrared interface 210(2) of the media controller 11 2112 may consist of the infrared receiver and omit the infrared transmitter. As described below, an infrared transmitter in the media controller remote 124 may be used to generate infrared signals 128 for controlling one or more of the media devices 10 4104.

The network interface 210(3) may be configured to connect the media controller 11 2112 wired or wirelessly to one or more networks 11 4114. These networks may include a LAN, WAN, WLAN, WWAN, and so forth. For example, the network interface 210(3) may comprise a transceiver and other devices configured to be compliant with the Institute of Electrical and Electronics Engineers ("IEEE") 8 602.11 standards. The network interface 210(3) may include a transceiver and other devices configured to be compliant with WWAN networks provided by one or more cellular carriers. For example, the network interface 210(3) may be configured to cellular data networks such as those based on the IEEE 8 602.16 standards such as WiMax.

The communication interface 210 of the media controller 11 2112 may also comprise the media device interface 10 8108 as described above. For example, several HDMI connections may be supported to allow coupling to one or more of the media devices 10 4104 such as the television media device 10 4104(1) to present a graphical user interface, or the sound system media device 10 4104(3) to present an audible user interface.

In other implementations other devices or components may be coupled to or incorporated within the media controller 11 2112. For example, digital rights management ("DRM") devices may be provided to control access to content.

The one or more memories 204 may store code or program instructions for execution by the processor 202 to perform certain actions or functions. In some implementations at least a portion of the instructions may be stored in external memory accessible to the media controller 112112, such as on the server 120.

These instructions in the one or more memories 204 may include an operating system 212. The operating system 212 is configured to manage hardware resources such as the I/O interfaces 206 and provide various services to applications executing on the processor 202.

The one or more memories 204 may also store a datastore 214 containing information about the operating system 212, configuration files, code table lookup 216 data, infrared signaling code tables 218 (or "code tables"), at least a portion of the data 110, the media device interface command map 118, and so forth. The datastore 214 may comprise a database, flat file, linked list, or other data structure.

The code table lookup 216 is configured to associate a particular media device 104 with a particular code table identifier. This code table identifier may be used to retrieve a particular code table 218. The code table 218 provides commands for a media device 104 and the infrared waveforms associated with the command.

As described above, the media device command map 118 is configured to associate an assigned action with a particular command on the media device interface 108. The media device command map 118 may generated at least in part by the media device interface learning module 116, be retrieved server 120, be pre-loaded into the memory 204 during manufacture, or a combination thereof. The media device interface command map 118 is discussed below with regard to FIG. 4.

A user interface module 220 is configured to provide a user interface for presentation to the user 102. For example, the user interface module 220 may generate images of a graphical user interface comprising elements such as menus and prompts for presentation on a display such as the television media device 104(1). In another example, the user interface module 220 may generate audible prompts for presentation using the sound system media device 104(3). The user interface module 220 may also be configured to accept input from the user 102. For example, the user interface module 220 may be configured to interpret input from the media controller remote 124 as selecting a particular element of the graphical user interface.

An infrared device programming module 222 is configured to determine a code table 218 associated with the media device 104, the media device remote 106, or both. When no code table 218 is available, the infrared device programming module 222 may build a code table 218. In some implementations, once built, this code table 218 may be provided to the server 120 and distributed to other media controllers 112.

The infrared device programming module 222 may determine one or more characteristics about the media device 104, the media device remote 106, or both. These characteristics may be obtained through a user interface generated by the user interface module 220. For example, the user 102 may be presented with a graphical user interface using the television media device 104(1) to select a particular make and model of the media device 104. In another implementation, one or more characteristics may be obtained without user intervention by information received at the communication interfaces 210, such as the infrared signals 128 generated by one or more of the media device remotes 106 using the infrared interface 210(2) of the media controller 112, the data 110 from the media device interface 108, or both. By analyzing this information the media device 104, the media device remote 106, or both may be determined. This information may be used by the media device interface learning module 116 to build the media device interface command map 118, described below in more detail with regard to FIGS. 4-08.

To provide for infrared remote control, once determined, at least a portion of the code table 218 may be sent to the media controller remote 124 using a radio signal 126 generated by the RF interface 210(1). With the code table 218, the media controller remote 124 is able to control the associated media device 104 using infrared signals 128.

When the media device interface command map 118 is available to control the media device 104, infrared signals 128 to the media device 104 by the media controller remote 124 may be omitted or discontinued. In one implementation, input from the user 102 using the media controller remote 124 for particular actions on the part of the media device 104 are received at the media controller 112 by the RF interface 210(1) and corresponding commands are generated using the media device interface command map 118. The commands may then be sent to the media device 104 via the media device interface 108.

An infrared device control module 224 may also be stored in the memory 204. As described above, some media devices 104 may not support control over the media device interface 108. The infrared device control module 224 is configured to generate commands for controlling one or more of the media devices 104 and sending the commands to the media controller remote 124 for transmission as infrared signals 128. These commands may be generated using the code table lookup 216 to determine a particular code table 218.

The media controller 112 may also be configured to present content. A content presentation module 226 may be stored in the memory 204. The content presentation module 226 is configured to present for consumption at least a portion of content to the users 102 using the I/O interfaces 206, the communication interfaces 210, or both. For example, the content presentation module 226 may be configured to retrieve a video stream from the server 120 using the network 114 and output the video stream or a rendering thereof out the media device interface 210(4) to the television media device 104(1) for presentation.

The media device interface learning module 116 ("learning module") may also be stored in the memory 204. As described above, the learning module 116 is configured to generate the media device interface command map 118 ("map"). This map may be based at least in part on learning input data such as the data 110, input from infrared receivers, user input from the user 102, and so forth. For example, the learning input data may include the data 110 as sent along the media device interface 108 as well as commands received from the user 102. The learning input data is described below in more detail with regard to FIG. 6. The map 118 associates particular actions of the media device 104 with commands. Operation of the learning module 116 is discussed below in more detail with regard to FIGS. 8-10. The media controller 112 may access the map 118 to control the one or more of the media devices 104 by sending the commands using the media device interface 108. When a particular command is not present in the map 118 or is otherwise unavailable for use on the media device interface 108 but is available on an infrared interface, the media controller 112 may initiate an infrared signal 128 from the media controller remote 124. In some implementations, the media device interface learning module 116 may be configured to verify or validate existing media device interface command maps 118. For example, a first map 118(1) may be provided to the media controller 112 for use. The media controller 112 may use the first map 118(1) and compare operation with that of a second map 118(2) generated by the media device interface learning module 116. Differences between the first and second maps 118 may be identified, tested, and used to generate a more accurate mapping between an assigned action and a command.

A media device interface ("MDI") device control module 228 may be stored in the memory 204. The MDI device control module 228 is configured to use the media device interface command map 118 to generate commands for the media device 104. These commands may then be sent to the media device 104 using the media device interface 108. For example, the content presentation module 226 may direct the MDI device control module 228 to direct the cable DVD player media device 104(2) to stop playing a DVD and direct the television media device 104(1) to accept input from the media controller 112. Other modules 230 may also be stored in the memory 204. For example, a user authentication module may be configured to authenticate the user 102 to determine what content is accessible to the user 102.

Figure 3:
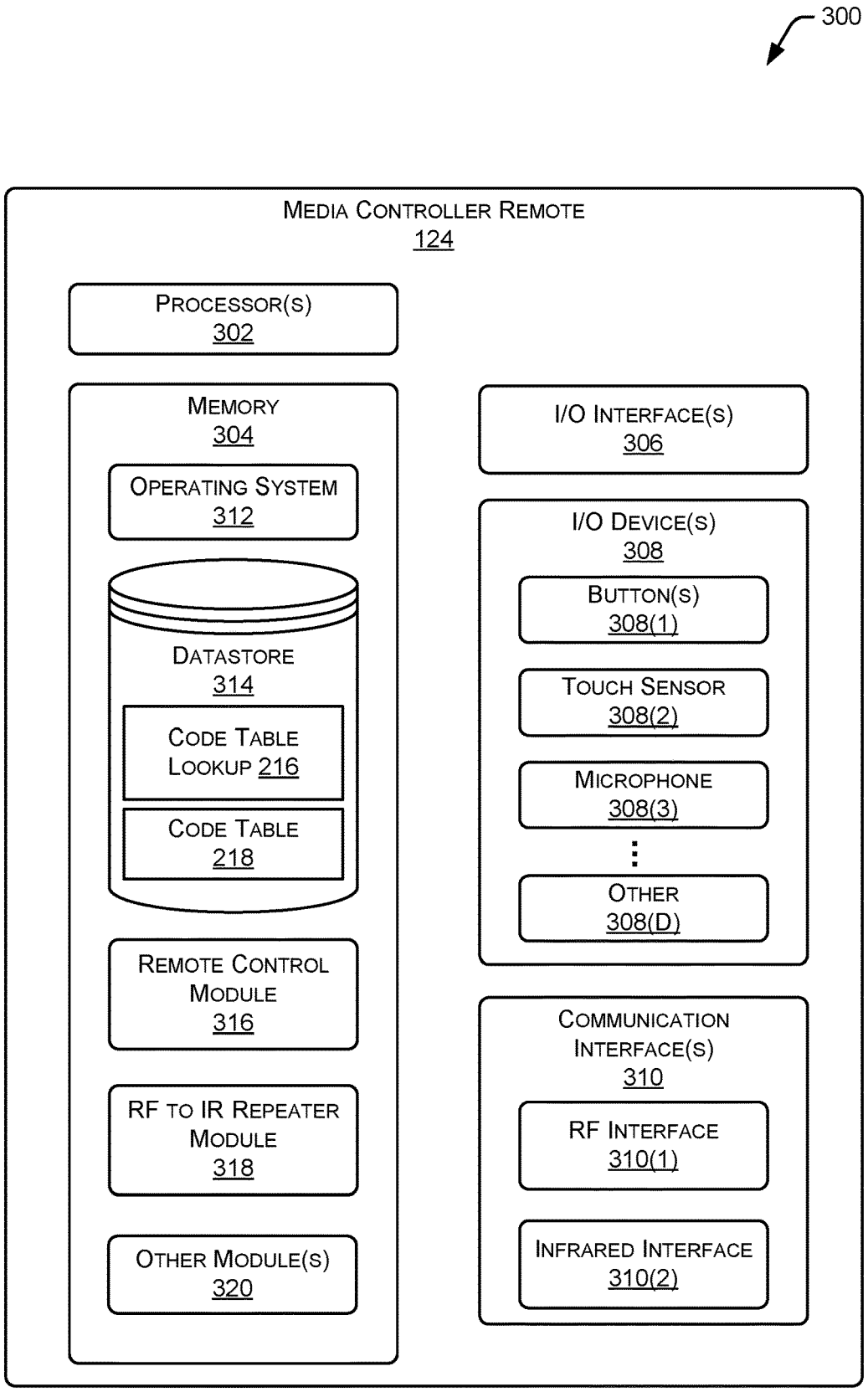
FIG. 3 illustrates a block diagram of a media controller remote configured to send commands to the one or more media devices using the media device interface command map and the media device interface.

FIG. 3 illustrates a block diagram 300 of the media controller remote 124. As described above, the media controller remote 124 may be used to control the media controller 112 and may be configured to control at least some of the one or more media devices 104. Similar to the media controller 112 described above, the media controller remote 124 may comprise one or more processors 302, one or more memories 304, one or more I/O interfaces 306, one or more I/O devices 308, and one or more communication interfaces 310.

The I/O devices 308 may include one or more buttons 308(1), touch sensors 308(2), microphones 308(3), and other I/O devices 308(D). The other I/O devices 308(D) may include, but are not limited to accelerometers, gyroscopes, light sensors, haptic output devices configured to provide a vibrotactile output, speakers, cameras, or digital light projectors.

The communications interfaces 310 may include an RF interface 310(1) and an infrared interface 310(2). These interfaces may be similar to the RF interface 210(1) and the infrared interface 210(2) described above with regard to FIG. 2. In some implementations, the infrared interface 310(2) may consist of an infrared transmitter.

The memory 304 may store an operating system module 312 and a datastore 314 similar to that described above. The datastore 314 may also store at least a portion of the code table lookup 216, at least a portion of one or more code tables 218 as provided by the infrared device programming module 222 of the media controller 112, or other data.

A remote control module 316 is configured to generate commands for transmission by the RF interface 310(1) or the infrared interface 310(2). The commands transmitted by the infrared interface 310(2) are based at least in part on the code table 218. The commands may be automatically initiated or manually initiated. Automatically initiated commands may also operate in conjunction with the MDI device control module 228.

Manually initiated commands include those resulting from the user 102 entering an input using one or more of the I/O devices 308. For example, the user 102 may press a button 308(1) on the media controller remote 124 which is assigned the command to power on the television media device 104(1).

An RF to infrared repeater module 318 may be stored in the memory 304. The RF to infrared repeater module 318 is configured to accept input from the RF interface 310(1) as received from the media controller 112 and transmit one or more infrared signals 128 using the infrared interface 310 (2).

The remote control module 316, the RF to IR repeater module 318, or both may be used in conjunction with the media device interface control module 228 to control the media device 104. For example, the remote control module 316, the RF to IR repeater module 318, or both may be used to send an infrared signal 128 to issue a command to the media device 104 which is available in the code table 218 but unavailable in the media device interface command map 118.

One or more other modules 320 may also be present in the memory 304. For example, a speech recognition module, biometric identification module, and so forth may be stored in the memory 304 and executed at least in part on the processor 302.

Figure 4:
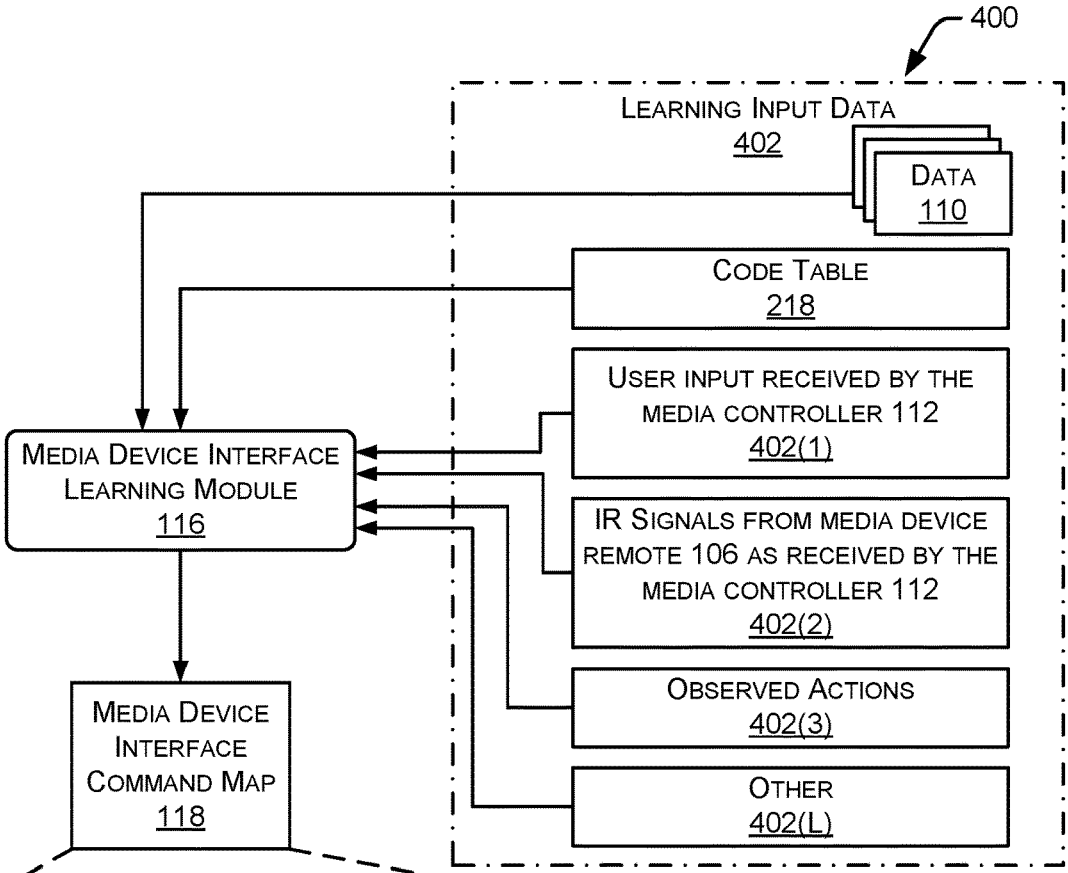
FIG. 4 illustrates learning inputs which may be used by the media device interface learning module to build the media device interface command map.

FIG. 4 illustrates a block diagram 400 of learning inputs 402 which may be used by the media device interface learning module 116 to build the media device interface command map 118. As described above, detailed information about data 110 sent along the media device interface 108 may not be available. As a result, it may be necessary to generate the map 118 before the media controller 112 is able to control the media device 104.

The media device interface learning module 116 may use learning input data 402 to generate the map 118. The learning and generation may be guided or automatic. In the guided mode, a series of user interfaces may be presented to the user. The user interfaces may direct the user to produce particular actions in the media device 104. For example, the user interface may request the user 102 turn on the DVD player. By monitoring the data 110 contemporaneous with these known actions, the map 118 may be generated.

In the automatic mode, the learning module 116 may acquire the learning input data 402 and builds the map 118 without intentional user interaction. For example, the learning module 116 may acquire the learning input data 402 over several hours, days, and so forth and correlate particular portions of the data 110 with particular actions by the media devices 104. The learning process is described below in more detail with regard to FIGS. 6 and 8.

The learning input data 402 may comprise one or more of: the data 110, the code table 218, user input 402(1), received infrared signals 402(2), observed actions 402(3), and other 402(L). As described above, the data 110 may be acquired by monitoring the media device interface 108. The code table 218 may be generated or retrieved. The user input 402(1) may include information received from the user 102 by the media controller 112, such as pressing the buttons 308(1) on the media controller remote 124.

The received infrared signals 402(2) include those received by the infrared interface 210(2) of the media controller 112. These may be signals generated by one or more of the media device remotes 106.

The observed action 402(3) is some change in the state or operation of the media device 104. For example, the observed action 402(2) may be the television media device 104(1) changing state from off to on. The observed action 402(3) may be elicited by presenting a prompt to the user 102. For example, the user 102 may see a user interface prompting them to "turn on the media device 104(1)." Upon following the direction of the prompt, the observed action 402(3) is the power on of the media device 104(1). The action is observed in that is a particular action elicited to generate a particular action on the media device 104 which may generate data 110 on the media device interface 108 for use by the media device interface learning module 116.

Other learning input data 402(L) may also be received. This other learning input data (L) may include speech, sound, images, and so forth. In one implementation, speech uttered by the user 102 may be received by the microphone 308(3) in the media controller remote 124 and recognized by processing on one or more processors. The speech may be recognized as describing what the observed actions 402(2) are. Similarly, the microphone 308(3) of the media controller remote 124 may be used to monitor output from the sound system media device 104(3) to determine observable actions 402(3) such as changes in volume or content being audibly presented.

In another example, the learning input data 402 may include images of the media devices 104 in operation, such as of the picture presented on the television media device 104(1). These images may provide observable actions 402 (3) such as a particular test pattern of image presented on the display to indicate current selection of an input source to the television media device 104.

The media device interface learning module 116 accesses the learning input data 402 and generates the media device interface command map 118. The map 118 may comprise a variety of attributes describing a relationship between commands and actions. These attributes may include, but are not limited to, a media device identifier 404, a command 406, and an assigned action 408. The media device identifier 404 designates what media devices 104 the command 406 may be used to control. The command 406 may comprise a string, value, or other information which, when at least a portion thereof is transmitted on the media device interface 108 is configured to result in the assigned action 408. For example, the command 406 value of "75702063610616e6e656c" may, when transmitted on the media device interface 108 cause the cable interface media device 104(4) to increment the currently selected channel by one. The commands 406 are depicted in this disclosure by way of illustration and not as a limitation as hexadecimal values. In other implementations other formats, encoding types, syntaxes, and so forth may be used.

The media device interface command map 118 may be generated in a centralized location configured to couple a variety of different media devices 104 to one or more media controllers 112. In one implementation a repair center, return center, distribution center, retail outlet, or other location may use the devices and techniques described in this disclosure to build media device interface command maps 118, definitive media device interface command maps 122, and so forth. For example, a return center may connect media devices 104 which have been returned for reasons other than malfunctioning to the media controller 112. An automated process or a human operator may initiate various actions on the media device 104 to generate data 110 on the media device interface 108. As described above, the media device interface learning module 116 may generate the map 118 based at least in part on the data 110.

Figure 5:
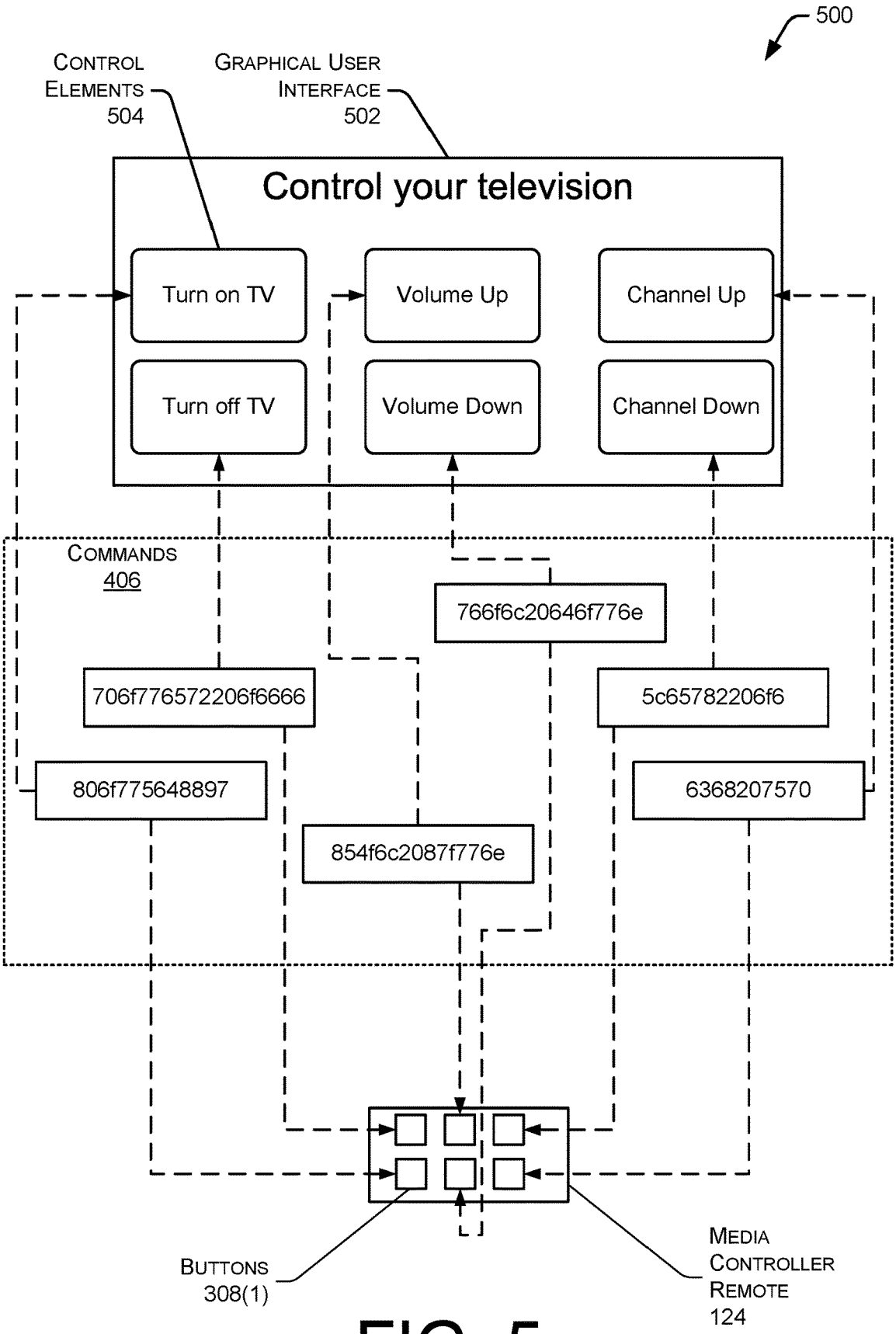
FIG. 5 illustrates user interfaces available for the user to control the media device using the media device interface command map and the media device interface.

FIG. 5 illustrates user interfaces 500 available for the user 102 to control the media device 104 using the media device interface command map 118 and the media device interface 108. Once the media device interface command map 118 is available, the commands 406 may be assigned to user interface elements for use.

A graphical interface 502 is depicted with various control elements 504 such as icons or visual representations of buttons for the user 102 to select using the media controller remote 124. Each of the control elements 504 are associated one or more of the commands 406. For example, the "channel up" control element 504 when activated will transmit the corresponding "6368207570" command 406 on the media device interface 108. In other implementations, an audible, haptic, or other user interface may also be used. For example, the user may utter speech to interact with the media controller 112.

Also depicted is the media controller remote 124 with the buttons 308(1) associated with the different commands 406. For example, pressing the associated button on the media controller remote 124 will also transmit the corresponding "6368207570" command 406 on the media device interface 108.

Illustrative Processes

Figure 6:
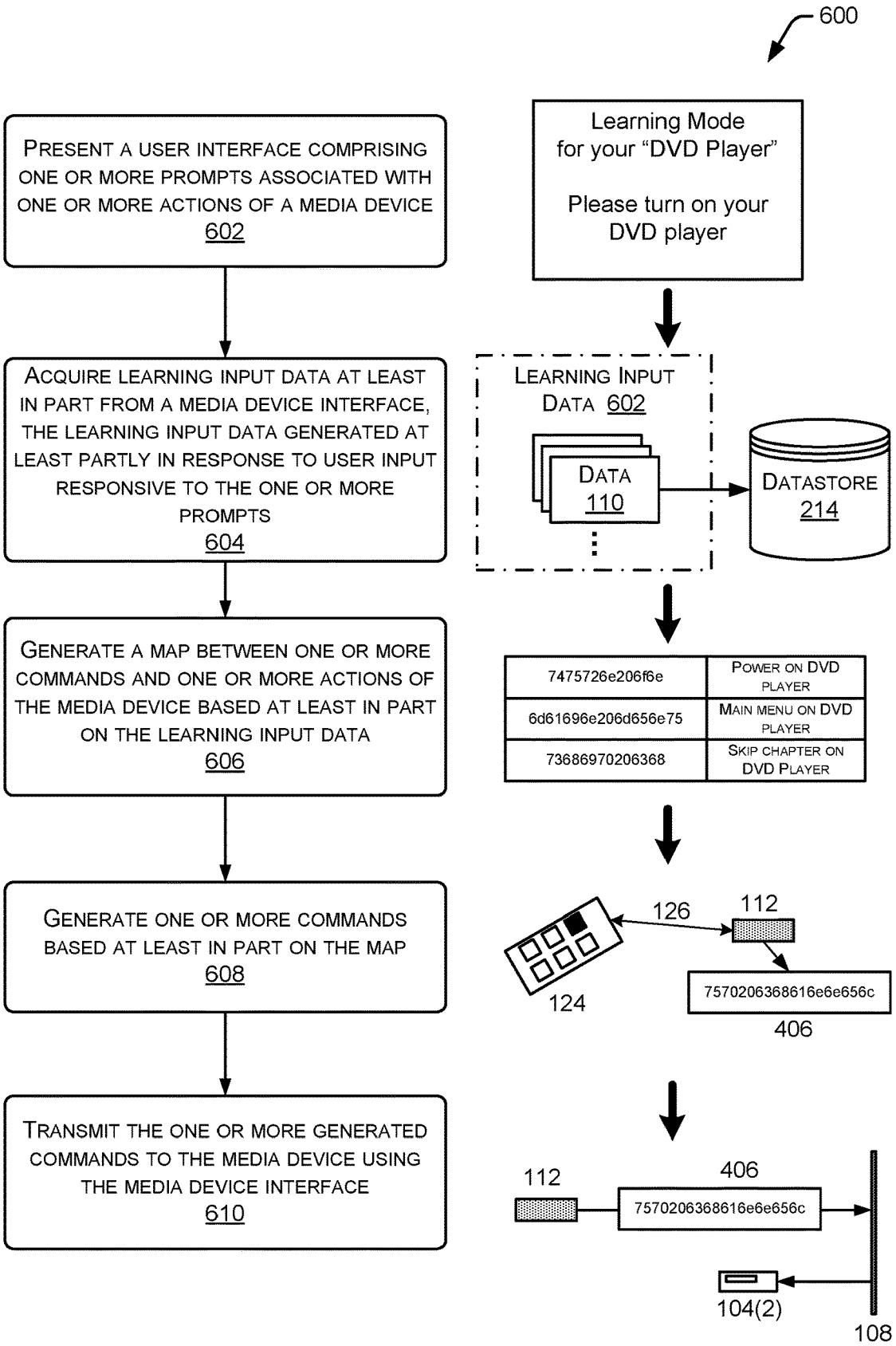
FIG. 6 illustrates a process for building a media device interface command map.

FIG. 6 illustrates a process 600 for building the media device interface command map 118. The process may be implemented at least in part by the media device interface learning module 116, and may be executed on the media controller 112, the server 120, or both. As described above, in some implementations the learning module 116 may guide the user 102 to generate particular actions on the media device 104 for which the map 118 is to be generated.

Block 602 presents a user interface comprising one or more prompts associated with one or more actions 408 of the media device 104. These one or more prompts are configured to generate one or more commands 406 on the media device interface 108. For example, in the user guided mode of building the map 118, the television media device 104(1) may present a graphical user interface asking the user 102 to turn on the DVD player media device 104(2) and perform other actions.

Block 604 acquires learning input data 402. This learning input data may be acquired at least in part from the media device interface 108. This learning input data 402 may be generated at least partly in response to user input responsive to the one or more prompts. As described above with regard to FIG. 4, the learning input data 402 may comprise at least a portion of: the data 110, the code table 218, the user input 402(1), the received infrared signals 402(2), the observed actions 402(3), and so forth.

The learning input data 402 may include commands 406 resulting at least in part by the user input in response to the user prompts. For example, the user 102 may turn on a particular media device 104 in response to a prompt to do so, and a corresponding command 406 may be transmitted by the media device 104 on the media device interface 108. In another implementation, the media device interface learning module 116 may omit block 602 and be configured to collect the learning input data 402 without explicitly prompting the user 102 to generate one or more commands 406.

The acquisition of block 604 may include processing at least a portion of data 110 received from the media device interface 108 to select data originating from or addressed to the media device 104. For example, where the map 118 is being built for the media device 104(4), data to and from that media device 104(4) may be selected for analysis.

The acquisition of block 604 may also include processing at least a portion of infrared signals received by the infrared interface 210(2) to select infrared signals 128 associated with the media device of interest.

In some implementations block 602 may be omitted, and block 604 may acquire the learning input data 402 without prior prompting of the user 102. For example, in an observation-only mode, the media controller 112 may be configured to receive the learning input data 402 such that as additional media devices 104(M) are added to the media device interface 108, the learning module 116 may begin to acquire the data for construction of the map 118.

Block 606 generates the media device interface command map 118 between the one or more commands 406 and the one or more actions 408 of the media device based at least in part on the learning input data 402.

In one implementation, generation of the map 118 may comprise associating the one or more commands 406 with the one or more actions 408 when a correlation factor between the one or more commands 406 and the one or more actions 408 reaches a pre-determined threshold. In another implementation, a heuristic analysis may be made of the learning input data 402 to determine the associations between the one or more comments 406 and the one or more actions 408.

Where data from the infrared interface 210(2) is available, the map 118 may also be based at least in part on the infrared signals 128. The generation of the map 118 may include retrieving one or more of the commands 502 associated with the selected infrared signals 128. The learning input data 402 contemporaneous with the receipt of the infrared signals 128 within a time window may be selected. At least a portion of the selected learning input data 402 may then be associated with the one or more commands 406.

Block 608 generates one or more commands 406 based at least in part on the map 118. For example, as described above with regard to FIG. 5, the user 102 may activate a button 308(1) on the media controller remote 124 which is configured to generate the action of incrementing the currently selected channel by one on the cable interface media device 104(4). Based on the map 118, the assigned action 408 of increasing incrementing the currently selected channel by one is associated with the command "75702063610616e6e656c."

In some implementations the generating may further comprise addition of addressing information. For example, each media device 104 may have a particular set of address bits used to designate a destination of the data 110.

Additionally, in another implementation the media controller 112 may be configured, as part of the generating the one or more commands, to indicate a source or originating media device 104 other than the media controller 112. For example, the media device 104(3) may be configured to accept commands 406 originating from the media device 104(4). In this implementation, the media controller 112 may send the one or more commands 406 to the media device 104(3) which are modified to appear as though they have been sent by the media device 104(4).

The map 118 may be tested by the media controller 112. For example, the media controller 112 may send commands querying for status of the media device 104 to verify the functionality of the commands. In some implementations the testing may be more intrusive by sending commands which affect the operation of the media device 104. For example, the media device 104 may be commanded to power on, power off, change inputs, and so forth. Commands which are accepted may be deemed valid, while unaccepted or commands resulting in an error or null response may be deemed invalid and removed from the map 118.

Block 610 transmits the one or more generated commands 406 to the media device 104 using the media device interface 108. With the one or more commands 406 configured to generate the assigned actions 408 on the particular media device 104, the media controller 112 is thus able to control the media device 104. In some implementations, the transmission may be used to verify or validate operation of the map 118.

Figure 7:
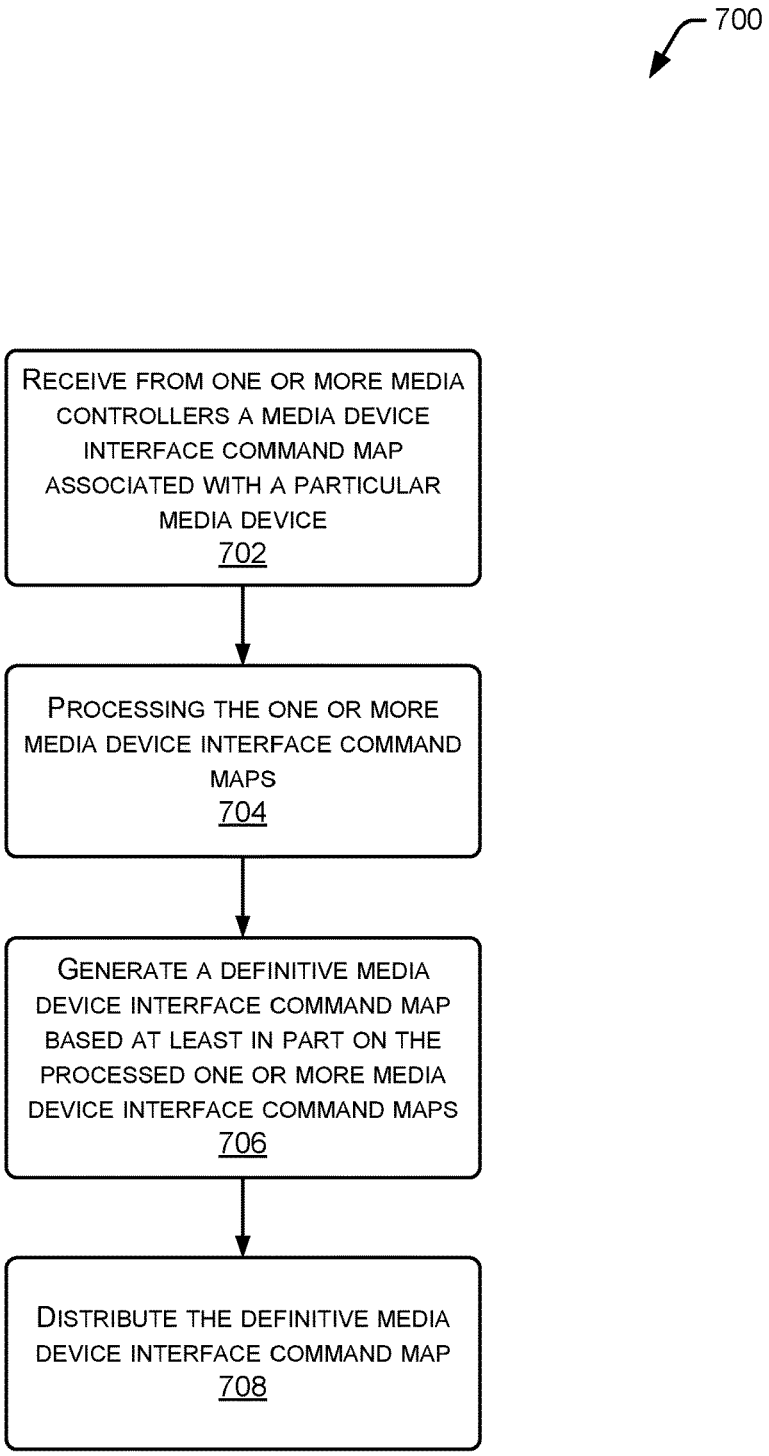
FIG. 7 illustrates a process for building a definitive media device interface command map.

FIG. 7 illustrates a process 700 for building the definitive media device interface command map 122. As described above, the definitive map 122 may be considered an authoritative or verified map. For example, the, server 120 may process a plurality of maps 118 received from different media controllers 112 to remove erroneous entries, incorrect mappings, and so forth to create the definitive map 122. The definitive map 122 may be generated by the media device interface learning module 116 executing at least in part on the server 120.

Block 702 receives from one or more media controllers 112 one or more media device interface command maps 118 associated with a particular media device 104 and configured to enable control of the media device 104 using the media device interface 108. The map 118 comprises information relating a particular action 408 of the particular media device 104 to a particular command 406 for transmission on the media device interface 108. The map 118 may be generated as described above with regard to FIG. 6.

Block 704 processes the one or more media device interface command maps 118. In some implementations, the process may include comparing mappings from a plurality of media device interface command maps 118 associated with the particular media devices 104. Based on the comparison, inconsistent mappings may be discarded. For example, an erroneous entry in a map 118 generated by the user's 102 response to a series of prompts may be removed. The process may include scanning for malicious or improperly formatted commands 406, detection of duplicative entries, and so forth.

Block 706 generates a definitive media device interface command map 122 based at least in part on the processed one or more media device interface command maps 118. As described above, the definitive map 122 may be considered an authoritative or verified map. The definitive map 122 may be based at least in part on the data 110 received from the media device interface 108.

Block 708 distributes the definitive media device interface command map 122 to the one or more media controllers 112. For example, this distribution may take place using the network 114. The definitive map 122 may replace or update existing maps present on the media controllers 114, or may be provided when the media controller 112 requests a map for a particular media device 104.

Figure 8:
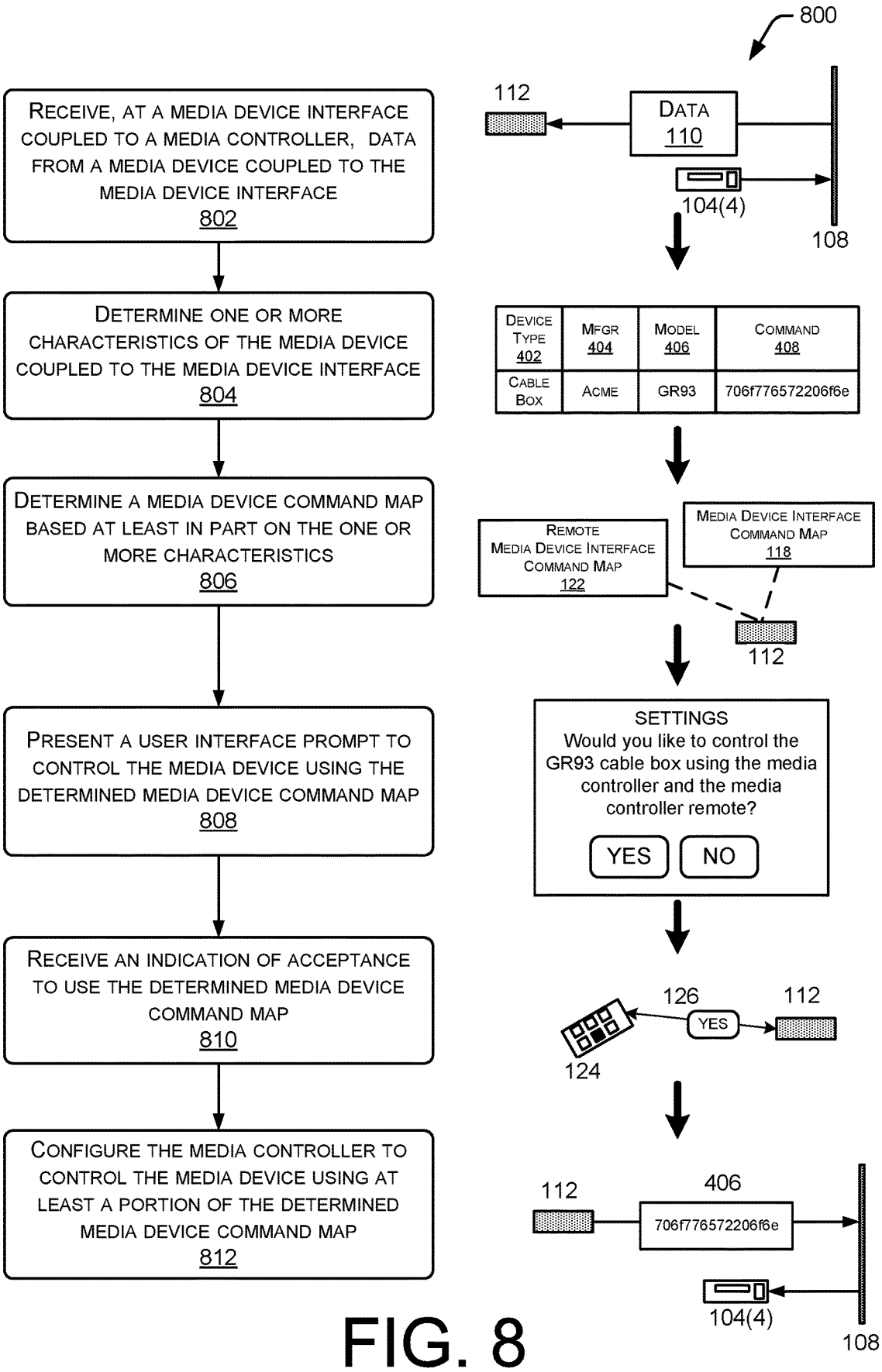
FIG. 8 illustrates a process for determining a media device interface command map to use to control a media device.

FIG. 8 illustrates a process 800 for determining the media device interface command map 118 or definitive map 122 to use to control the media device 104. This process may be implemented on the media controller 112, the server 120, or both.

Block 802 receives, at the media device interface 108 coupled to the media controller 112, data 110 from the media device 104 coupled to the media device interface 108. For example, a newly added media device 104(5) may be coupled to the media device interface 108 and powered on, generating various data 110.

Block 804 determines one or more characteristics of the media device 104 coupled to the media device interface 108. For example, the one or more characteristics may include one or more of: the media device ID 404, the commands 406, device type 402, manufacturer 404, model 406, production year, physical description, or picture of the media device. For example, the data 110 may comprise an announcement including the media device ID 404 for the particular devices, such as "GR93." In another example, the user 102 may be prompted to input the one or more characteristics via the media controller remote 124 information.

Block 806 determines the media device command map 118 based at least in part on the one or more characteristics. For example, the media device ID 404 may be compared to the data in the media device interface command map 118 to find corresponding entries in the map. When a corresponding map 118 is present, that map may be selected for use by the media controller 112.

Block 808 may present a user interface prompt to the user 102 to allow the media controller 112 to control the media device 104 using the determined media device command map 118. For example, a graphical user interface may be presented on the television media device 104(1) notifying the user 102 that the media device 104 has been identified and if the media controller 112 is permitted to control this media device 104. In some implementations, the user interface prompt may be omitted and the process may proceed to block 812.

Block 810 receives an indication of acceptance to use the determined media device command map 118. For example, the user 102 may press a button 308(1) on the media controller remote 124 to select the "yes" option presented on the graphical user interface.

Block 812 configures the media controller 112 to control the media device 104 using at least a portion of the determined media device command map 118. For example, the media controller remote 124 may discontinue sending infrared signals 128 to the media device 104, and instead send commands to the media device 104 using the media device interface 108.

In some implementations commands may be sent to the media device 104 using the media device interface 108 as well as with the infrared signals 128. For example, when the command 502 to turn off the television exists in the code table 218 and the map 118, the command 402 from the map 118 may be sent on the media device interface 108. In comparison, when the command 502 to display an onscreen menu is present in the code table 218 for infrared signals 218 but no corresponding command 406 is present in the media device interface command map 118, the media controller remote 124 may be used to send the infrared signal 128 of the command 502. This provides the user 102 functionality for a seamless user interface even when the media device interface command map 118 is incomplete or still in the process of being built.

Figure 9:
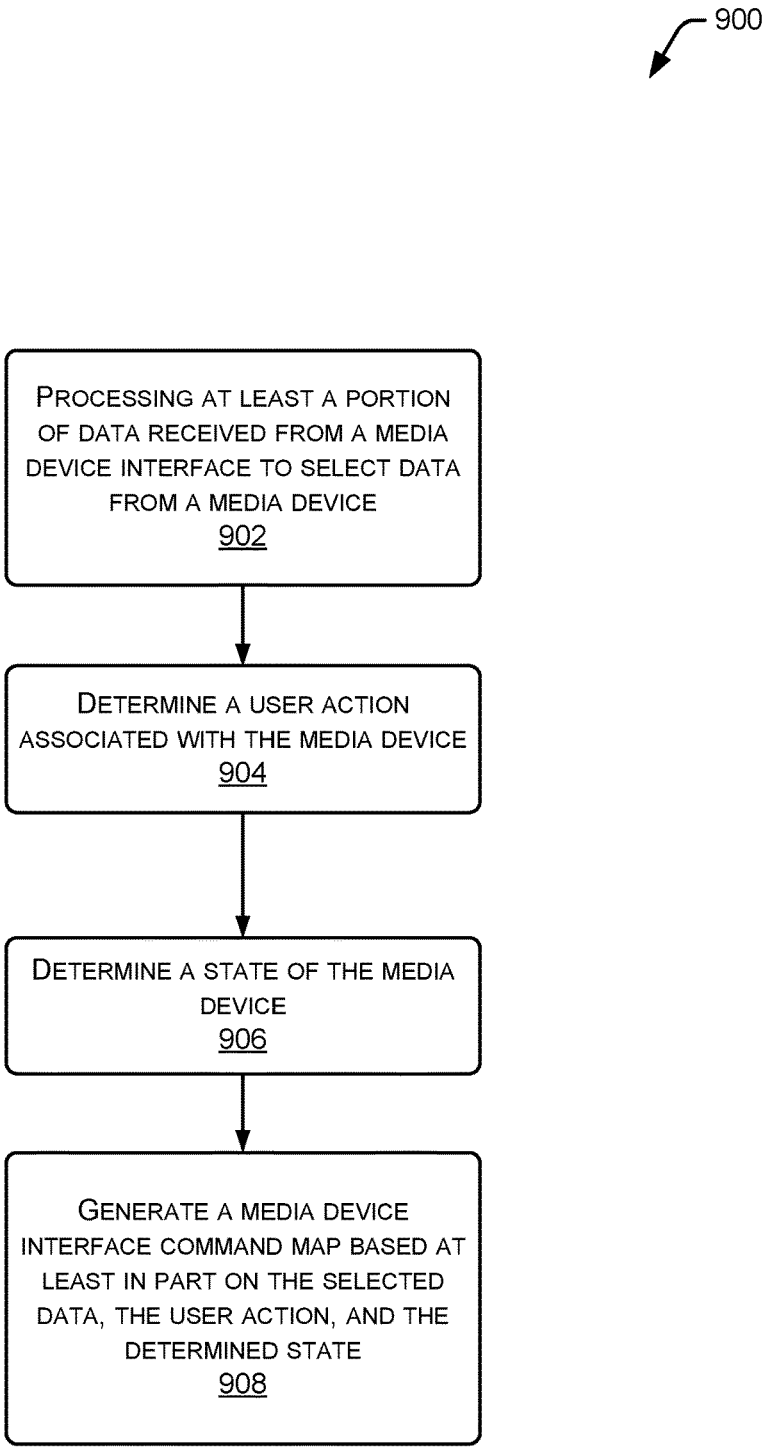
FIG. 9 illustrates another process for building a media device interface command map.

FIG. 9 illustrates another process 900 for building a media device interface command map 118. This process may be implemented on the media controller 112, the server 120, or both.

Block 902 processes at least a portion of data received from the media device interface 108 to select data 110 originating from or addressed to the media device 104. For example, the media controller 112 may be configured to apply a filter to look for source or destination addresses associated with the media device 104.

Block 904 determines a user action associated with the media device 104. The user action may include the user input 402(1), the observed actions 402(3), and so forth. For example, the user action may be determined by the user providing input on a remote control device, such as the media controller remote 124. In some implementations the media device 104 may present a user interface comprising one or more prompts configured to generate data on the media device interface 108.

Block 906 determines a state of the media device. For example, the media controller 112 may interrogate the media device 104 using one or more interrogatory commands sent using the media device interface 108. These interrogatory commands may be configured to return information such as device status, operating characteristics, and so forth.

In another example, other commands may be sent to the media device 104. Responses to these commands may then be used to determine the state. For example, sending a command to play a DVD may be unresponsive when the media device 104 state is off. Unrecognized codes may result in a response indicating that the code was not accepted by the media device 104, and this data may be used to determine the state or other aspects of the device.

Block 908 generates a media device interface command map based at least in part on the selected data, the user action, and the determined state. For example, the user action of selecting an output on the DVD player media device 104(2) as determined by information in the determined state may be used to map the selected data 110 sent along the media device interface 108 with that particular action.

CONCLUSION

The operations and processes described and shown above may be carried out or performed in any suitable order as desired in various implementations. Additionally, in certain implementations, at least a portion of the operations may be carried out in parallel. Furthermore, in certain implementations, less than or more than the operations described may be performed.

Certain aspects of the disclosure are described above with reference to block and flow diagrams of systems, methods, apparatuses, and/or computer program products according to various implementations. It will be understood that one or more blocks of the block diagrams and flow diagrams, and combinations of blocks in the block diagrams and the flow diagrams, respectively, can be implemented by computer-executable program instructions. Likewise, some blocks of the block diagrams and flow diagrams may not necessarily need to be performed in the order presented, or may not necessarily need to be performed at all, according to some implementations.

These computer-executable program instructions may be loaded onto a special-purpose computer or other particular machine, a processor, or other programmable data processing apparatus to produce a particular machine, such that the instructions that execute on the computer, processor, or other programmable data processing apparatus create means for implementing one or more functions specified in the flow diagram block or blocks. These computer program instructions may also be stored in a computer-readable storage media or memory that can direct a computer or other programmable data processing apparatus to function in a particular manner, such that the instructions stored in the computer-readable storage media produce an article of manufacture including instruction means that implement one or more functions specified in the flow diagram block or blocks. As an example, certain implementations may provide for a computer program product, comprising a computer-readable storage medium having a computer-readable program code or program instructions implemented therein, said computer-readable program code adapted to be executed to implement one or more functions specified in the flow diagram block or blocks. The computer program instructions may also be loaded onto a computer or other programmable data processing apparatus to cause a series of operational elements or steps to be performed on the computer or other programmable apparatus to produce a computer-implemented process such that the instructions that execute on the computer or other programmable apparatus provide elements or steps for implementing the functions specified in the flow diagram block or blocks.

Accordingly, blocks of the block diagrams and flow diagrams support combinations of means for performing the specified functions, combinations of elements or steps for performing the specified functions and program instruction means for performing the specified functions. It will also be understood that each block of the block diagrams and flow diagrams, and combinations of blocks in the block diagrams and flow diagrams, can be implemented by special-purpose, hardware-based computer systems that perform the specified functions, elements or steps, or combinations of special-purpose hardware and computer instructions.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language is not generally intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A device comprising:

at least one memory that stores computer-executable instructions; and at least one processor configured to access the at least one memory and execute the computer-executable instructions to:

receive a first media device command map from a first media controller device, wherein the first media device command map is for a first media device of a first type;

receive a second media device command map from a second media controller device, wherein the second media device command map is for a second media device of the first type;

determine that first command data in the first media device command map for a first media device action is different than second command data in the second media device command map for the first media device action;

determine that third command data in a third media device command map for the first media device action is the same as the first command data; and generate a definitive media device command map for the first media device comprising the first command data for the first media device action.

2. The device of claim 1, wherein the at least one processor is further configured to access the at least one memory and execute the computer-executable instructions to:

send data associated with the definitive media device command map to the second media controller device, wherein the definitive media device command map replaces the second media device command map at the second media controller device.

3. The device of claim 1, wherein the at least one processor is further configured to access the at least one memory and execute the computer-executable instructions to:

determine that the first media device command map is missing command data for a second media device action;

determine that the second media device command map comprises fourth command data for the second media device action; and send the fourth command data to the first media controller device.

4. The device of claim 3, wherein the definitive media device command map for the first media device comprises the fourth command data for the second media device action.

5. The device of claim 1, wherein the at least one processor is further configured to access the at least one memory and execute the computer-executable instructions to:

cause the first media controller device to update the first media device command map with the definitive media device command map; and cause the second media controller device to update the second media device command map with the definitive media device command map.

6. The device of claim 1, wherein the at least one processor is further configured to access the at least one memory and execute the computer-executable instructions to:

determine a second media device action in the first media device command map that is associated with fourth command data;

determine a third media device action in the second media device command map that is associated with fifth command data, wherein the fifth command data is the same as the fourth command data;

generate a first erroneous command data notification for the second media device action; and generate a second erroneous command data notification for the third media device action.

7. The device of claim 1, wherein the first media device command map and the second media device command map comprise command data that cause respective actions to be performed by the first media device.

8. A device comprising:

at least one memory that stores computer-executable instructions; and at least one processor configured to access the at least one memory and execute the computer-executable instructions to:

receive a first media device command map from a first media controller device, wherein the first media device command map is for a first media device of a first type;

receive a second media device command map from a second media controller device, wherein the second media device command map is for a second media device of the first type;

determine a first media device action in the first media device command map that is associated with first command data;

determine a second media device action in the second media device command map that is associated with second command data, wherein the second command data is the same as the first command data;

determine that third command data in a third media device command map is associated with the first media device action, wherein the third command data is the same as the first command data; and generate a definitive media device command map for the first media device comprising the first command data for the first media device action.

9. The device of claim 8, wherein the at least one processor is further configured to access the at least one memory and execute the computer-executable instructions to:

send data associated with the definitive media device command map to the second media controller device, wherein the definitive media device command map replaces the second media device command map at the second media controller device.

10. The device of claim 8, wherein the at least one processor is further configured to access the at least one memory and execute the computer-executable instructions to:

determine that the first media device command map is missing command data for a third media device action;

determine that the second media device command map comprises fourth command data for the third media device action; and send the fourth command data to the first media controller device.

11. The device of claim 10, wherein the definitive media device command map for the first media device comprises the fourth command data for the second media device action.

12. The device of claim 8, wherein the at least one processor is further configured to access the at least one memory and execute the computer-executable instructions to:

cause the first media controller device to update the first media device command map with the definitive media device command map; and cause the second media controller device to update the second media device command map with the definitive media device command map.

13. The device of claim 8, wherein the at least one processor is further configured to access the at least one memory and execute the computer-executable instructions to:

determine that fourth command data in the first media device command map for a third media device action is different than fifth command data in the second media device command map for the third media device action; and determine that sixth command data in the third media device command map for the third media device action is the same as the fourth command data;

wherein the definitive media device command map for the first media device comprises the fourth command data for the third media device action.

14. The device of claim 8, wherein the first media device command map and the second media device command map comprise command data that cause respective actions to be performed by the first media device.

15. The device of claim 8, wherein the at least one processor is further configured to access the at least one memory and execute the computer-executable instructions to:

compare the first command data in the first media device command map to the second command data in the second media device command map.

16. The device of claim 8, wherein the at least one processor is further configured to access the at least one memory and execute the computer-executable instructions to:

generate a first erroneous command data notification for the second media device action.

17. A method comprising:

receiving, by one or more computer processors coupled to at least one memory device, a first media device command map from a first media controller device, wherein the first media device command map is for a first media device of a first type;

receiving a second media device command map from a second media controller device, wherein the second media device command map is for a second media device of the first type;

determining that first command data in the first media device command map for a first media device action is different than second command data in the second media device command map for the first media device action;

determining that third command data in a third media device command map for the first media device action is the same as the first command data; and generating a definitive media device command map for the first media device comprising the first command data for the first media device action.

18. The method of claim 17, further comprising:

determining that the first media device command map is missing command data for a third media device action;

determining that the second media device command map comprises fourth command data for the third media device action; and sending the fourth command data to the first media controller device.

19. The method of claim 17, further comprising:

determining that fourth command data in the first media device command map for a third media device action is different than fifth command data in the second media device command map for the third media device action; and determining that sixth command data in the third media device command map for the third media device action is the same as the fourth command data;

wherein generating the definitive media device command map for the first media device comprising the first command data for the first media device action comprises generating the definitive media device command map for the first media device comprising the first command data for the first media device action and the fourth command data for the third media device action.

* * * * *